US008934807B2

(12) United States Patent
Takahashi

(10) Patent No.: US 8,934,807 B2
(45) Date of Patent: Jan. 13, 2015

(54) IMAGE FORMING APPARATUS

(71) Applicant: KYOCERA Document Solutions Inc., Osaka-shi, Osaka (JP)

(72) Inventor: Satoru Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 75 days.

(21) Appl. No.: 13/685,776

(22) Filed: Nov. 27, 2012

(65) Prior Publication Data

US 2013/0136484 A1 May 30, 2013

(30) Foreign Application Priority Data

Nov. 30, 2011 (JP) ..... 2011-261895
Mar. 14, 2012 (JP) ..... 2012-056984

(51) Int. Cl.
*G03G 21/20* (2006.01)
*G03G 21/16* (2006.01)

(52) U.S. Cl.
CPC ..... *G03G 21/206* (2013.01); *G03G 21/1619* (2013.01); *G03G 21/1652* (2013.01)
USPC ..... 399/92; 399/107

(58) Field of Classification Search
CPC combination set(s) only.
See application file for complete search history.

(56) References Cited

U.S. PATENT DOCUMENTS 5,559,581 A * 9/1996 Sugiura et al. ..... 399/111
5,561,496 A 10/1996 Sugiura et al.
5,918,089 A * 6/1999 Malinich et al. ..... 399/90
2004/0095456 A1* 5/2004 Yoshihara et al. ..... 347/152
2004/0130700 A1 7/2004 Ogi et al.
2006/0034633 A1 2/2006 Tsusaka et al.
2010/0098451 A1 4/2010 Tsusaka et al.
2011/0205327 A1 8/2011 Inoue

FOREIGN PATENT DOCUMENTS

JP 2001-194980 A * 1/2000 ..... G03G 15/20
JP 2001-194980 7/2001
JP 2002-99124 4/2002
JP 2005-77639 3/2005
JP 2006-053254 2/2006
JP 200653254 2/2006
JP 2006-119234 5/2006
JP 2006239876 9/2006

OTHER PUBLICATIONS

Japanese Office Action—Jun. 17, 2014.

* cited by examiner

*Primary Examiner* — Clayton E. Laballe
*Assistant Examiner* — Jas Sanghera
(74) *Attorney, Agent, or Firm* — Gerald E. Hespos; Michael J. Porco; Matthew T. Hespos

(57) ABSTRACT

An image forming apparatus has a chassis, an image forming section, a shield metal plate, and a plurality of substrates. The chassis has a first surface and a second surface on an opposite side to the first surface. The image forming section is disposed in an internal space formed between the first and second surfaces of the chassis and performs an image forming process on a sheet. The shield metal plate is provided vertically between the second surface and the image forming section and has a third surface facing a side of the first surface and a fourth surface facing a side of the second surface. The plurality of substrates are provided vertically on the third surface of the shield metal plate and have electrical components protruding toward the first surface.

8 Claims, 11 Drawing Sheets

IMAGE FORMING APPARATUS

This application is based on Japanese Patent Application No. 2011-261895 filed in Japan Patent Office on Nov. 30, 2011 and Japanese Patent Application No. 2012-056984 filed in Japan Patent Office on Mar. 14, 2012, the contents of both of which are hereby incorporated by reference.

BACKGROUND

The present disclosure relates to an image forming apparatus for performing image forming processes on sheets, and particularly to an image forming apparatus provided with a plurality of substrates having electrical components.

In an image forming apparatus a plurality of substrates with electrical components are disposed in order to operate various devices disposed inside the apparatus main body. The plurality of substrates consist of a high-voltage substrate for transforming a commercial AC voltage into a predetermined high voltage and supplying the high voltage to the devices mounted inside of the image forming apparatus, a control substrate for outputting various control signals to the image forming apparatus, and other substrates.

In some cases high-frequency electromagnetic noises enter the electrical components disposed on the substrates. In order to prevent the generation of noises in the electrical components, the periphery of each substrate is shielded by a shield metal plate. In a prior art, a special shield is disposed in each of the plurality of substrates, to electrically protect the electrical components mounted on the substrates.

In the prior art, substrate surfaces of the plurality of substrates with the electrical components are oriented in different directions. Furthermore, the special shield is disposed in each of the substrates, as described above. This leads to an increase in the volume of the space that is required for surrounding the individual substrates with the shields. Moreover, the area of each metal shield increases, resulting in an increase in the cost of the apparatus.

The present disclosure was contrived in view of the foregoing problems, and an object thereof is to reduce, as much as possible, the space occupied by a plurality of substrates in an apparatus main body.

SUMMARY

An image forming apparatus according to one aspect of the present disclosure has a chassis, an image forming section, a shield metal plate, and a plurality of substrates. The chassis has a first surface and a second surface on an opposite side to the first surface. The image forming section is disposed in an internal space formed between the first and second surfaces of the chassis and performs an image forming process on a sheet. The shield metal plate is provided vertically between the second surface and the image forming section and has a third surface facing a side of the first surface and a fourth surface facing a side of the second surface. The plurality of substrates are provided vertically on the third surface of the shield metal plate and have electrical components protruding toward the first surface.

DETAILED DESCRIPTION

Figure 1:
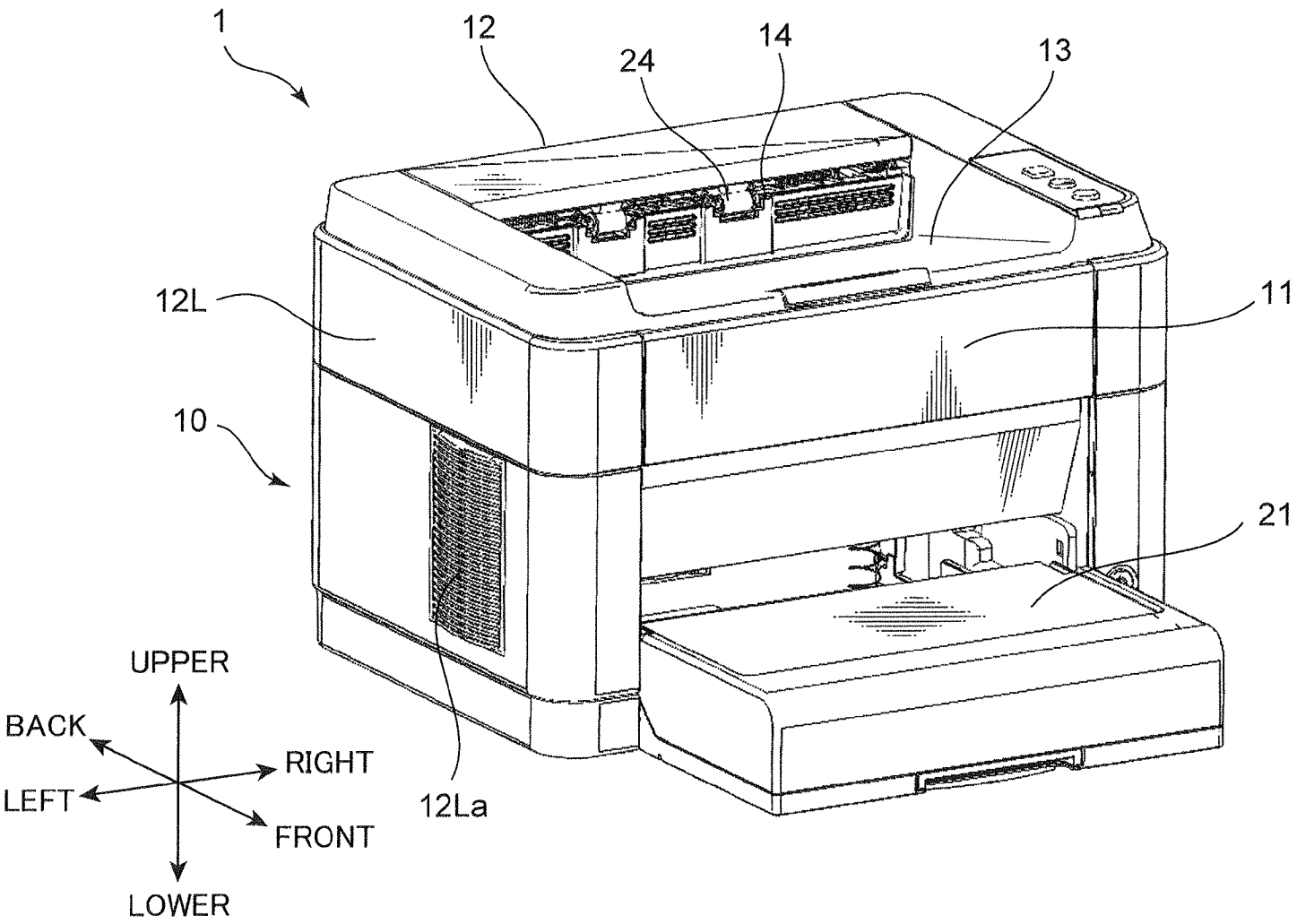
FIG. 1 is a perspective view showing an exterior of an image forming apparatus 1 according to an embodiment of the present disclosure.
Figure 2:
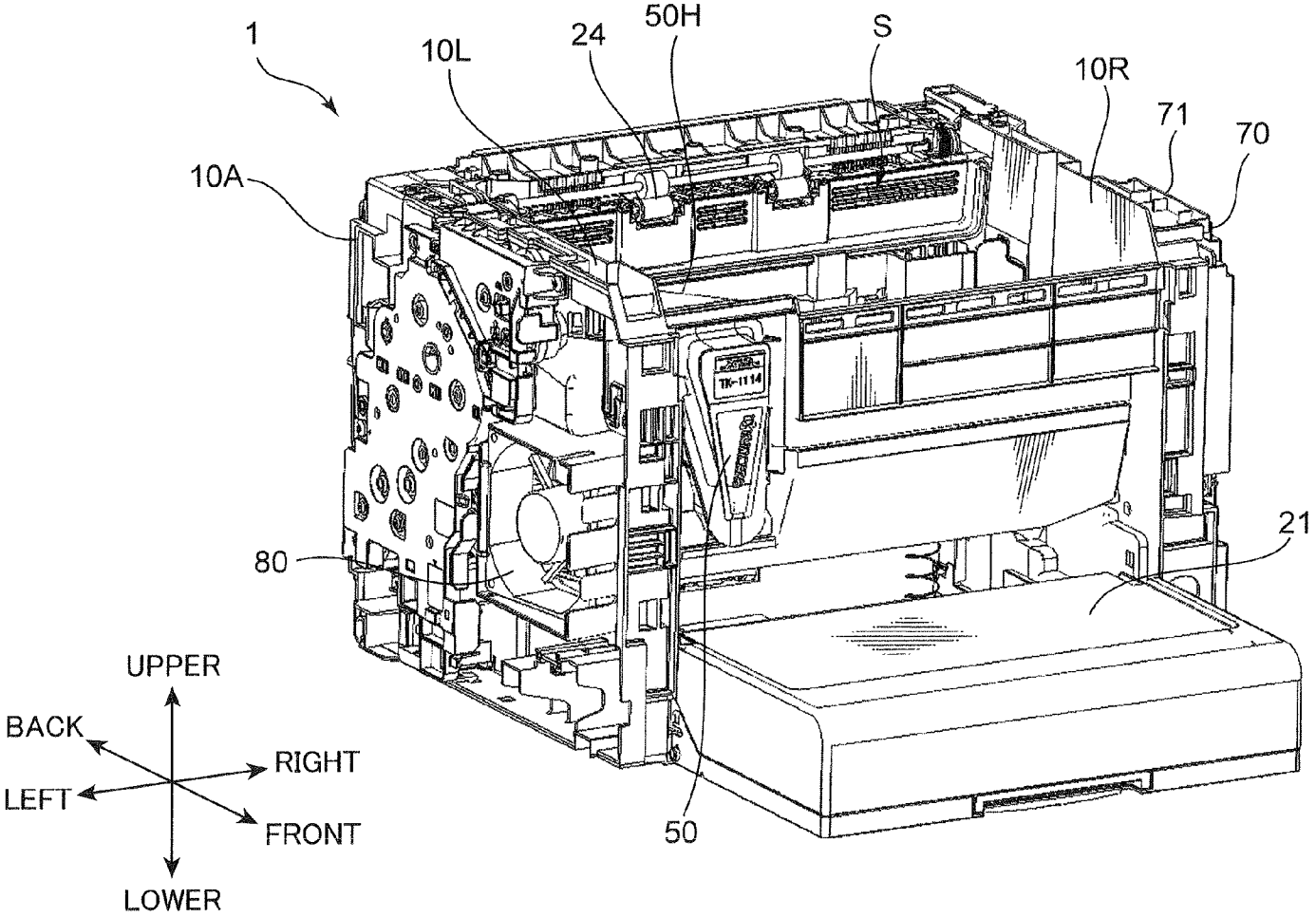
FIG. 2 is a perspective view showing an internal structure of the image forming apparatus 1 according to an embodiment of the present disclosure.
Figure 3:
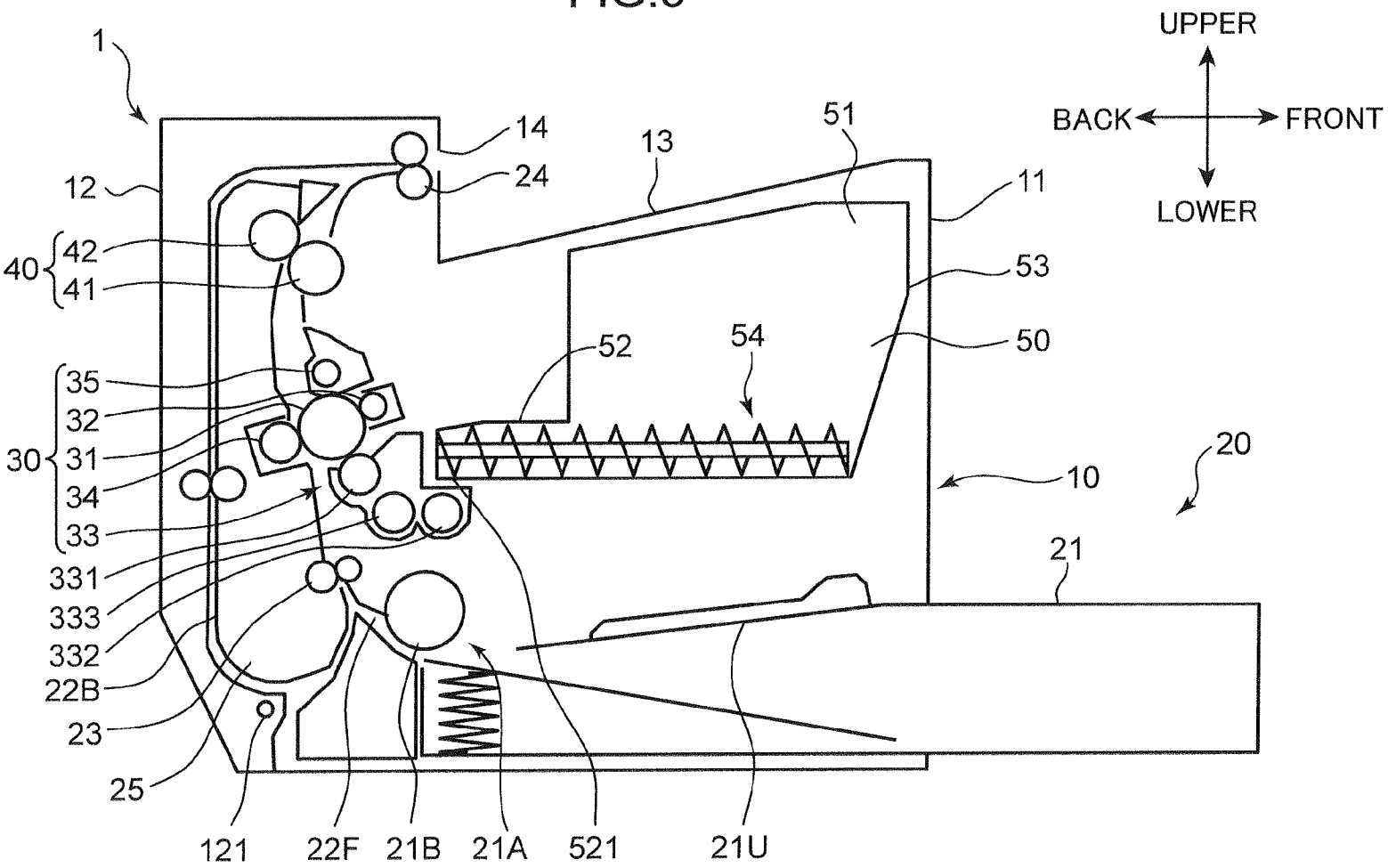
FIG. 3 is a side cross-sectional view showing the internal structure of the image forming apparatus 1 according to an embodiment of the present disclosure.
Figure 4:
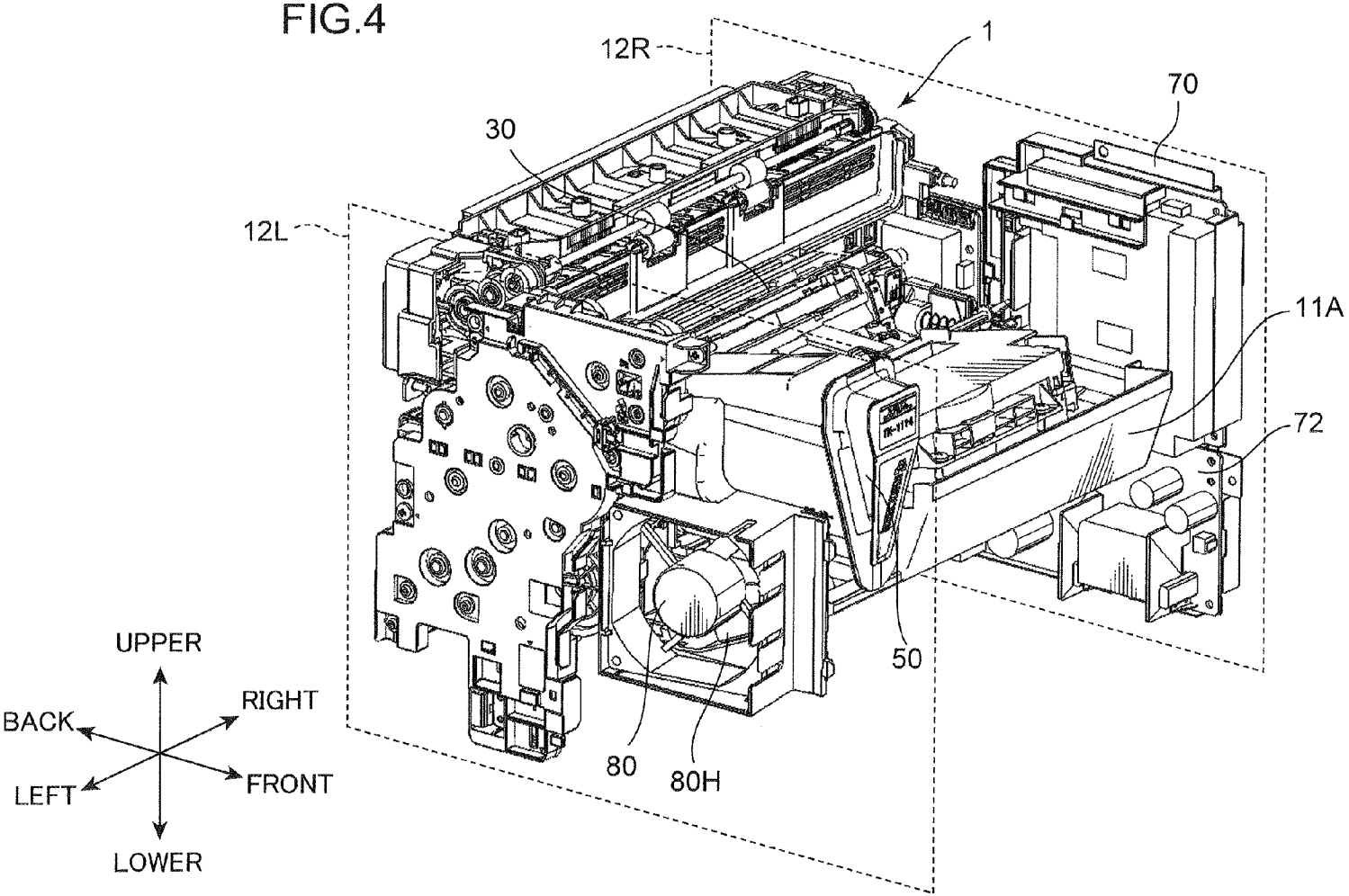
FIG. 4 is a perspective view for explaining the internal structure of the image forming apparatus 1 according to an embodiment of the present disclosure.
Figure 5:
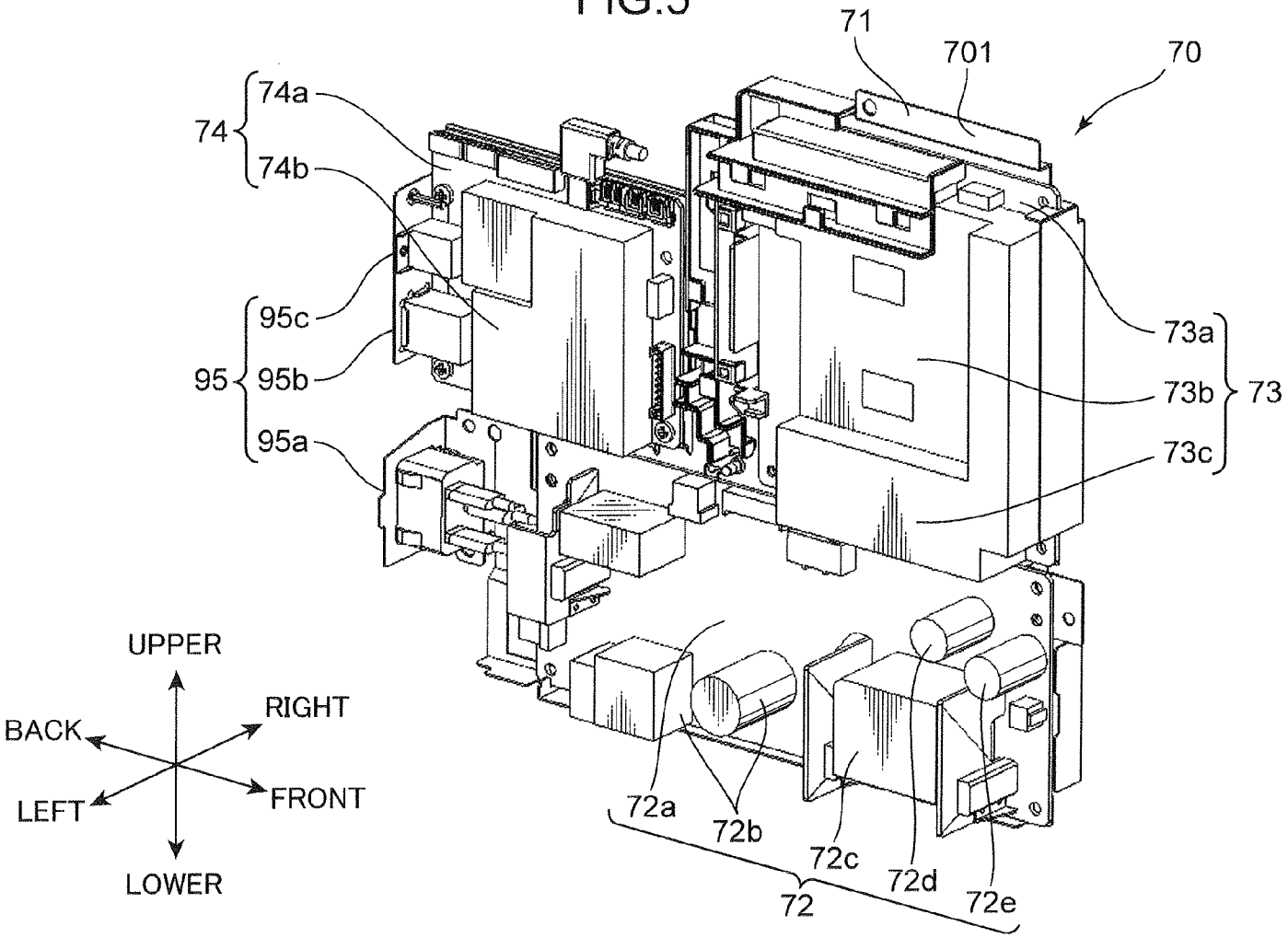
FIG. 5 is a perspective view showing an exterior of a substrate unit 70 according to an embodiment of the present disclosure.

Embodiments of the present disclosure are now described hereinafter in detail with reference to the drawings. While arrows indicating front and back, up and down, and left and right are provided in the drawings in order to describe an image forming apparatus 1 according to the present embodiment, orientations of the image forming apparatus 1 are not limited thereto. FIG. 1 is a perspective view showing an exterior of the image forming apparatus 1 according to an embodiment of the present disclosure. FIG. 2 is a perspective view showing an internal structure of the image forming apparatus 1. FIG. 2 shows a state where respective covers and an image forming section 30, which are described hereinafter, are removed in FIG. 1. In addition, FIG. 3 is a side cross-sectional view showing the internal structure of the image forming apparatus 1. FIG. 4 is a perspective view showing a placement of a substrate unit 70. FIG. 5 is a perspective view showing a configuration of the substrate unit 70. While a black-and-white printer is exemplified herein as the image forming apparatus 1, the image forming apparatus may alternatively be a copier, a facsimile machine, or a multifunction printer that combines functions of a copier and a facsimile machine. Furthermore, an image forming apparatus that forms color images may also be adopted.

The image forming apparatus 1 includes a main body housing (chassis) which has a chassis structure with an approximately rectangular parallelepiped shape, a paper feeding section 20 housed inside the main body housing 10, an image forming section 30, a fixing section 40, a toner container 50, a substrate unit 70, and a cooling fan 80.

A front cover 11 is provided on a front side and a rear cover 12 is provided on a rear side of the main body housing 10. Opening the front cover 11 exposes the toner container 50, as shown in FIG. 2. Accordingly, when toner runs out, a user can take out the toner container 50 from the front side of the main body housing 10. The rear cover 12 is a cover that is opened in the event of a sheet jam or upon maintenance. By opening the rear cover 12, the image forming section 30 and the fixing section 40 can respectively be taken out from the rear side of the main body housing 10. In addition, a left cover 12L (FIG. 1) (first wall) and a right cover 12R (not shown in FIG. 1) (second wall) on an opposite side to the left cover 12L are respectively provided on side surfaces of the main body housing 10 so as to extend in a vertical direction. An air inlet 12La for carrying air into the main body housing 10 is provided on a front-side portion of the left cover 12L. Furthermore, a paper ejecting section 13 on which a sheet after image formation is ejected is provided on an upper surface of the main body housing 10. Various devices for executing image formation are mounted inside an internal space S (FIG. 2) that is defined by the front cover 11, the rear cover 12, the left cover 12L, the right cover 12R, and the paper ejecting section 13.

A main body frame 10A, which is exposed by removing the front cover 11, the rear cover 12, the left cover 12L, and the right cover 12R, is disposed inside the main body housing 10. The main body frame 10A is a box-shaped framework portion of the image forming apparatus 1. The main body frame 10A is made from a flame-retardant resin material. In the present embodiment, a resin material corresponding to a UL-approved flame-retardant grade (V0) is adopted for the main body frame 10A. The main body frame 10A can satisfy fire enclosure of the image forming apparatus 1. In other words, materials having flame-retardant grades lower than that of the main body frame 10A can be adopted for the front cover 11, the rear cover 12, the left cover 12L, and the right cover 12R, which are disposed farther out than the main body frame 10A. As a result, while maintaining the fire protection performance required in the image forming apparatus 1, the cost of the resin materials adopted in the image forming apparatus 1 can be lowered.

The main body frame 10A has a left frame 10L (counter wall section) and a right frame 10R (wall section) (FIG. 2). The left frame 10L supports various devices on the side of the left cover 12L of the main body housing 10A. In addition, the right frame 10R supports various devices on the side of the right cover 12R of the main body housing 10A. The image forming section 30 and the fixing section 40 that extend in a horizontal direction are supported by the left frame 10L and the right frame 10R. In other words, the left frame 10L is disposed between the left cover 12L and the image forming section 30. The right frame 10R is disposed between the right cover 12R and the image forming section 30.

The paper feeding section 20 includes a paper cassette 21 that houses sheets on which an image forming process is performed (FIG. 3). A part of the paper cassette 21 protrudes forward from the front of the main body housing 10. In the paper cassette 21, an upper surface of a portion housed inside the main body housing 10 is covered by a paper cassette top plate 21U. The paper cassette 21 has a sheet housing space that houses a stack of the sheets described above, and is provided with a lift plate that lifts up the sheet stack when feeds paper, and the like. A sheet feeding section 21A is provided in an upper part on a rear end side of the paper cassette 21. A pickup roller 21B for feeding one sheet at a time from the top of the sheet stack in the paper cassette 21 is disposed in the sheet feeding section 21A.

The image forming section 30 performs an image forming process in which a toner image is formed on a sheet that is sent out from the paper feeding section 20. The image forming section 30 includes a photosensitive drum 31, and a charging device 32, an exposure device (not shown in FIG. 3), a developing device 33, a transfer roller 34, and a cleaning device 35 that are disposed around the photosensitive drum 31. The image forming section 30 is provided between the left cover 12L (first surface) and the right cover 12R (second surface) or, more specifically, between the left frame 10L and the right frame 10R.

As the photosensitive drum 31 rotates around a shaft thereof, an electrostatic latent image and a toner image are formed on a circumferential surface thereof. A photosensitive drum made of an amorphous silicon (a-Si) based material can be used as the photosensitive drum 31. The charging device 32 uniformly charges a surface of the photosensitive drum 31 and includes a charging roller that comes into abutment with the photosensitive drum 31. The cleaning device 35 includes a cleaning roller and the like, and cleans toner attached to the circumferential surface of the photosensitive drum 31 after transfer of a toner image and conveys the toner to a recovery device (not shown). In addition, the photosensitive drum 31, the charging device 32, and the cleaning device 35 are integrally constructed as a drum unit (not shown).

The exposure device has a laser light source and an optical system device such as a mirror or a lens. The exposure device irradiates the circumferential surface of the photosensitive drum 31 with laser light modulated based on image data supplied from an external device such as a personal computer in order to form an electrostatic latent image. The developing device 33 supplies toner to the circumferential surface of the photosensitive drum 31 in order to develop the electrostatic latent image on the photosensitive drum 31 to form a toner image. The developing device 33 includes a developing roller 331 that carries toner to be supplied to the photosensitive drum 31, and a first conveying screw 332 and a second conveying screw 333 that circulate and convey a developer while agitating the developer inside a development housing (not shown).

The transfer roller 34 is a roller for transferring the toner image formed on the circumferential surface of the photosensitive drum 31 onto a sheet, and forms a transfer nip section together with the photosensitive drum 31. A transfer bias with a reverse polarity to the toner is applied to the transfer roller 34.

The fixing section 40 performs a fixing process for fixing the transferred toner image onto a sheet. The fixing section 40 includes a fixing roller 41 provided with an internal heat source and a pressure roller 42 that is pressed against the fixing roller 41 and forms a fixing nip section together with the fixing roller 41. When a sheet onto which the toner image is transferred is sent to the fixing nip section, the toner image is fixed onto the sheet by heat applied by the fixing roller 41 and pressure applied by the pressure roller 42.

The toner container 50 stores toner that is replaced in the developing device 33. The toner container 50 includes a container main body 51 that is a primary storage location of toner, a cylindrical section 52 that protrudes from a lower part of one side surface of the container main body 51, a lid member 53 that covers the other side surface of the container main body 51, and a rotating member 54 that is housed inside the container and conveys toner. When the rotating member 54 is driven to rotate, the toner stored inside the toner container 50 is supplied to the inside of the developing device 33 through a toner outlet 521 provided on a lower surface of a tip of the cylindrical section 52. The toner container 50 is provided at a position that is above and immediately to the right (inward) of the left frame 10L (FIG. 2). Furthermore, the container 50 is positioned below the paper ejecting section 13 (see FIG. 3).

A main conveying path 22F and a reverse conveying path 22B are provided inside the main body housing 10 for conveying sheets. The main conveying path 22F extends from the sheet feeding section 21A of the paper feeding section 20 to a paper outlet 14 provided so as to oppose the paper ejecting section 13 on the upper surface of the main body housing 10 via the image forming section 30 and the fixing section 40. The reverse conveying path 22B is a conveying path that is used when performing duplex printing on a sheet in order to return a sheet printed on one side to an upstream position along the main conveying path 22F with respect to the image forming section 30.

A resist roller pair 23 is disposed on an upstream side of the transfer nip section constituted by the photosensitive drum 31 and the transfer roller 34 along the main conveying path 22F. A sheet is stopped by the resist roller pair 23, subjected to skew correction, and is then sent out to the transfer nip section at a predetermined image transfer timing. A plurality of conveying rollers for conveying sheets are disposed at appropriate locations along the main conveying path 22F and the reverse conveying path 22B. For example, a discharge roller pair 24 is disposed in the vicinity of the paper outlet 14.

The reverse conveying path 22B is formed between an outer surface of a reversing unit 25 and an inner surface of the rear cover 12 of the main body housing 10. Moreover, the transfer roller 34 and one of the rollers of the resist roller pair 23 are mounted on an inner surface of the reversing unit 25. The rear cover 12 and the reversing unit 25 are respectively rotatable around an axis of a fulcrum section 121 provided at lower ends of the rear cover 12 and the reversing unit 25. When a sheet jam occurs along the reverse conveying path 22B, the rear cover 12 is opened. When a sheet jam occurs along the main conveying path 22F or when removing a unit of the photosensitive drum 31 or the developing device 33 to the outside, the reversing unit 25 is opened in addition to the rear cover 12.

The cooling fan 80 (FIG. 2) is provided at a position on an outer side (left side) of the left frame 10L and to the front of the left frame 10L. In other words, the cooling fan 80 is provided between the left cover 12L and the image forming section 30 in a horizontal direction (a direction intersecting with the left cover 12L and the right cover 12R) (see FIG. 2). The cooling fan 80 has a rotating shaft (not shown), a fan motor (not shown), and a plurality of blade members 80H (FIG. 4). The fan motor rotates when a drive current is supplied from a power supply (not shown) and rotates the blade members 80H via the rotating shaft. The blade members 80H rotate so as to form a rotational plane that is approximately parallel to the left cover 12L. Due to the rotation of the blade members 80H, air outside the main body housing 10 is taken in from the air inlet 12La and an airflow oriented toward the inside of the main body housing 10 is created. The airflow is blown to the substrate unit 70, which is described hereinafter, via the internal space S. Particularly, the airflow cools a power substrate 72 positioned in a lower part of the substrate unit 70, is heated, and is then guided upward. After cooling a high-voltage substrate 73 and a control substrate 74 that are positioned above the power substrate 72, the airflow is discharged to the outside of the image forming apparatus 1.

The substrate unit 70 is provided on an outer side (right side) of the right frame 10R (FIG. 2). In other words, the substrate unit 70 is provided between the right cover 12R and the image forming section 30 in the horizontal direction (the direction intersecting with the left cover 12L and the right cover 12R) (see FIG. 4). A plurality of circuit boards are focused in the substrate unit 70.

With reference to FIG. 5, the substrate unit 70 has a shield metal plate 71, the power substrate 72 (substrate), the high-voltage substrate 73 (substrate), and the control substrate 74 (substrate).

Figure 8:
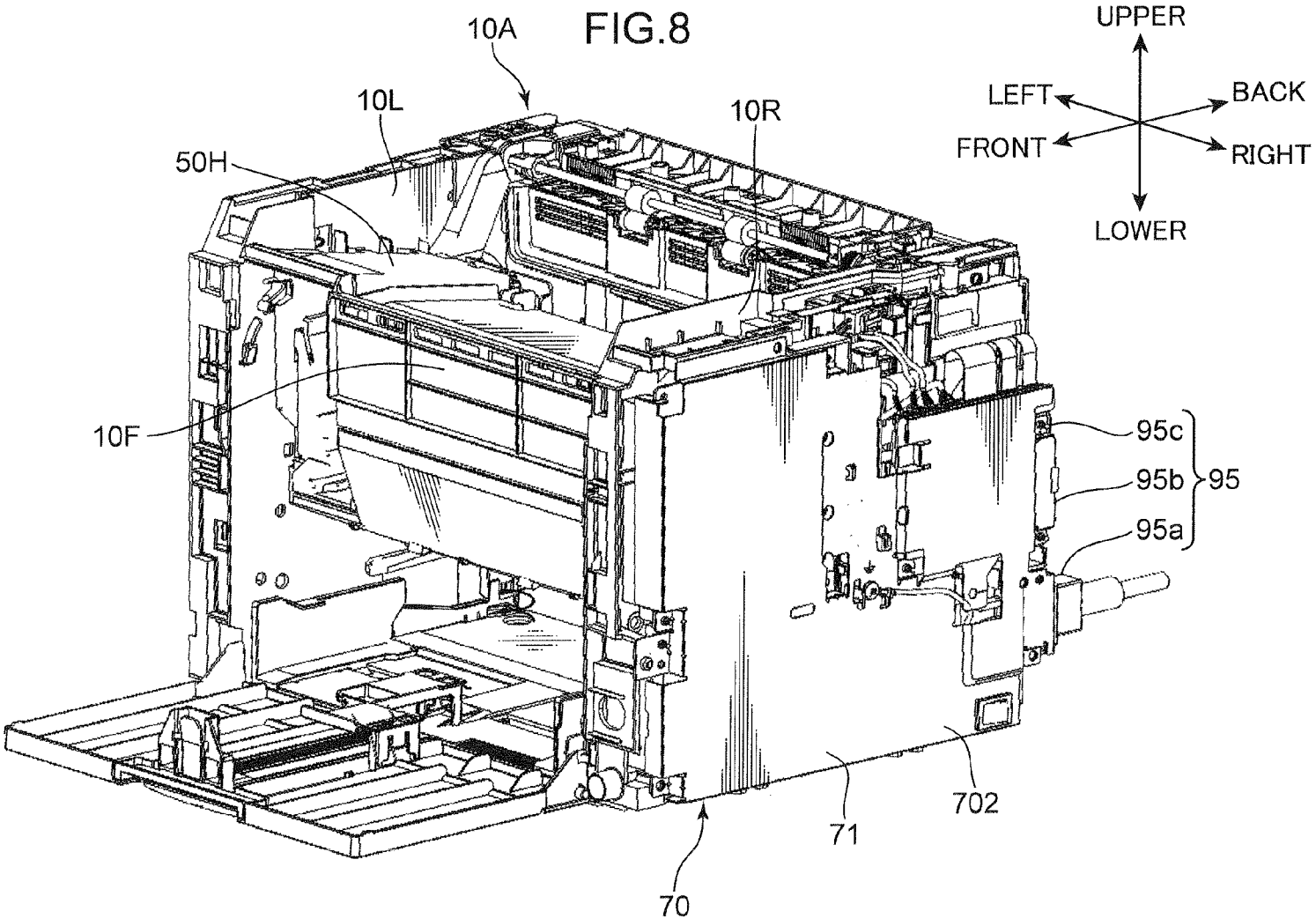
FIG. 8 is a perspective view for explaining the main body frame 10A according to an embodiment of the present disclosure.

The shield metal plate 71 is a metal plate that defines one side surface of the substrate unit 70 and holds the plurality of substrates described above. The shield metal plate 71 has a substantially rectangular shape. The shield metal plate 71 is disposed vertically between the right cover 12R and the right frame 10R so as to be parallel to the right cover 12R and the right frame 10R (see FIGS. 2 and 4). The shield metal plate 71 has a metal plate inner surface section 701 (first surface) and a metal plate outer surface section 702 (second surface) (FIG. 8). The metal plate inner surface section 701 is a surface that faces the left cover 12L in the shield metal plate 71 (FIG. 1), and the metal plate outer surface section 702 is a surface facing the right cover 12R. The shield metal plate 71 is disposed inside the image forming apparatus 1 and functions to electrically protect the plurality of substrates.

The power substrate 72 is constituted by a flat plate-like wiring board 72*a*, a plurality of electrical elements 72*b* (electrical components) mounted on the wiring board 72*a*, a coil 72*c* (electrical component), a first capacitor 72*d* (electrical component), and a second capacitor 72*e* (electrical component). The power substrate 72 acts as a primary power supply for the image forming apparatus 1. The power substrate 72 generates voltages of 24 V and 5 V. The voltage is supplied to the electrical equipment housed inside the image forming apparatus 1. The electrical elements 72*b*, the coil 72*c*, the first capacitor 72*d*, and the second capacitor 72*e* are fixed to the wiring board 72*a* in such a manner as to protrude from the wiring board 72*a* to the left (toward the left cover 12L). The power substrate 72 is disposed vertically, together with the other substrates, on the metal plate inner surface section 701 of the shield metal plate 71.

The high-voltage substrate 73 is constituted by a flat plate-like upper substrate 73*a* and a high-voltage power-supply box 73*b* mounted on the upper substrate 73*a*. The high-voltage substrate 73 transforms a commercial AC voltage into a predetermined high voltage and supplies the predetermined voltage to the internal equipment of the image forming apparatus 1. The high-voltage power-supply box 73*b* has a power section 73*c* (electrical component). The power section 73*c* has a substantially L-shape. The power section 73*c* has an electrical component therein and is provided on the upper substrate 73*a* in such a manner as to protrude to the left. The high-voltage substrate 73 is disposed vertically, together with the other substrates, on the metal plate inner surface section 701 of the shield metal plate 71.

The control substrate 74 is constituted by a flat plate-like supporting substrate 74*a* and a control box 74*b* (electrical component) mounted on the supporting substrate 74*a*. Various electrical elements are disposed in the control box 74*b*. The control substrate 74 outputs various control signals to the image forming apparatus 1. The control box 74*b* is provided on the supporting substrate 74*a* in such a manner as to protrude to the left. The control substrate 74 is disposed vertically, together with the other substrates, on the metal plate inner surface section 701 of the shield metal plate 71.

As shown in FIG. 5, in the present embodiment, the wiring board 72*a*, the upper substrate 73*a*, and the supporting substrate 74*a* are disposed adjacent to each other on a large surface of the shield metal plate 71. In addition, the control substrate 74 and the high-voltage substrate 73 are consecutively disposed in a direction of respective planes thereof so as to be approximately vertical (in an upward direction) with respect to the power substrate 72. As shown, in the present embodiment, a plurality of substrates are disposed as intensively as possible in the substrate unit 70 that is disposed between the right cover 12R and the right frame 10R. Therefore, compared to a case where a plurality of substrates are dispersed inside the main body housing 10, a smaller space is occupied by the main body housing 10.

In particular, in the present embodiment, the image forming section 30 is disposed in the internal space S (FIG. 2) and the substrate unit 70 is disposed between the image forming section 30 and the right cover 12R. Therefore, the plurality of substrates can be provided using the height of the image forming section 30 and an occupied space in the height direction of the image forming apparatus 1 can be minimized.

Moreover, the substrate unit 70 has a connector section 95. The connector section 95 has a first connector 95*a*, a second connector 95*b*, and a third connector 95*c*. Each of these connectors supplies a predetermined voltage to the electrical components held in the shield metal plate 71. Each of these connectors supplies a predetermined voltage, which is generated from the electrical components on each substrate, to each device provided inside the image forming apparatus 1. The first connector 95*a*, the second connector 95*b*, and the third connector 95*c* are provided along a rear side (one of the sides) of the shield metal plate 71. Therefore, the connectors connected to the substrate unit 70 are focused in one section in the main body housing 10. As a result, electric wires that are connected to the plurality of substrates in the main body housing 10 are disposed as intensively as possible.

In the present embodiment, the power substrate 72, the high-voltage substrate 73, and the control substrate 74 are connected electrically to the shield metal plate 71. A ground wire, which is grounded in advance, is connected to the shield metal plate 71. As a result, the power substrate 72, the high-voltage substrate 73, and the control substrate 74 are grounded by the ground wire. This can prevent poor grounding of each substrate, allowing the image forming apparatus 1 to operate electrically stably.

Figure 6:
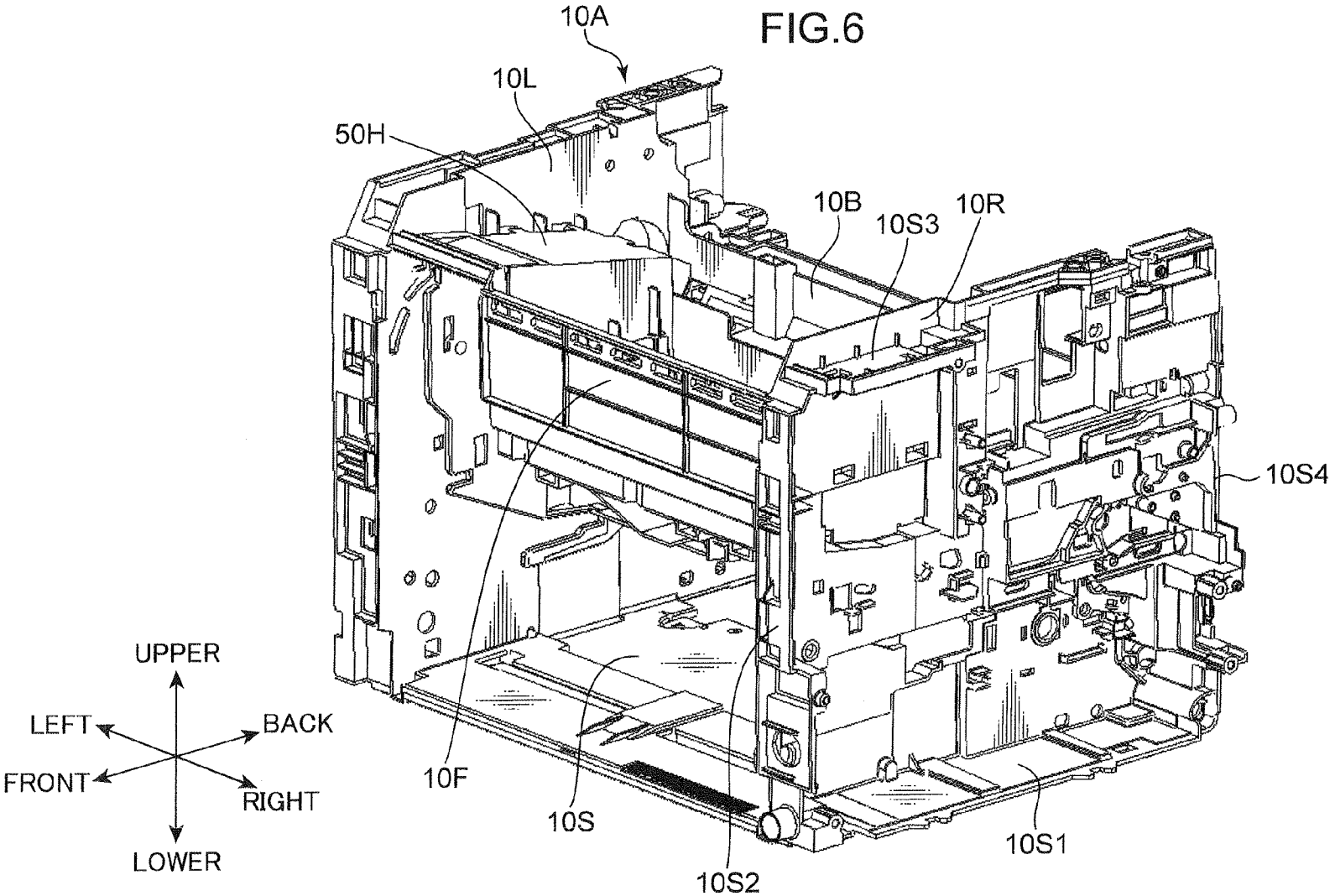
FIG. 6 is a perspective view for explaining a main body frame 10A according to an embodiment of the present disclosure.
Figure 7:
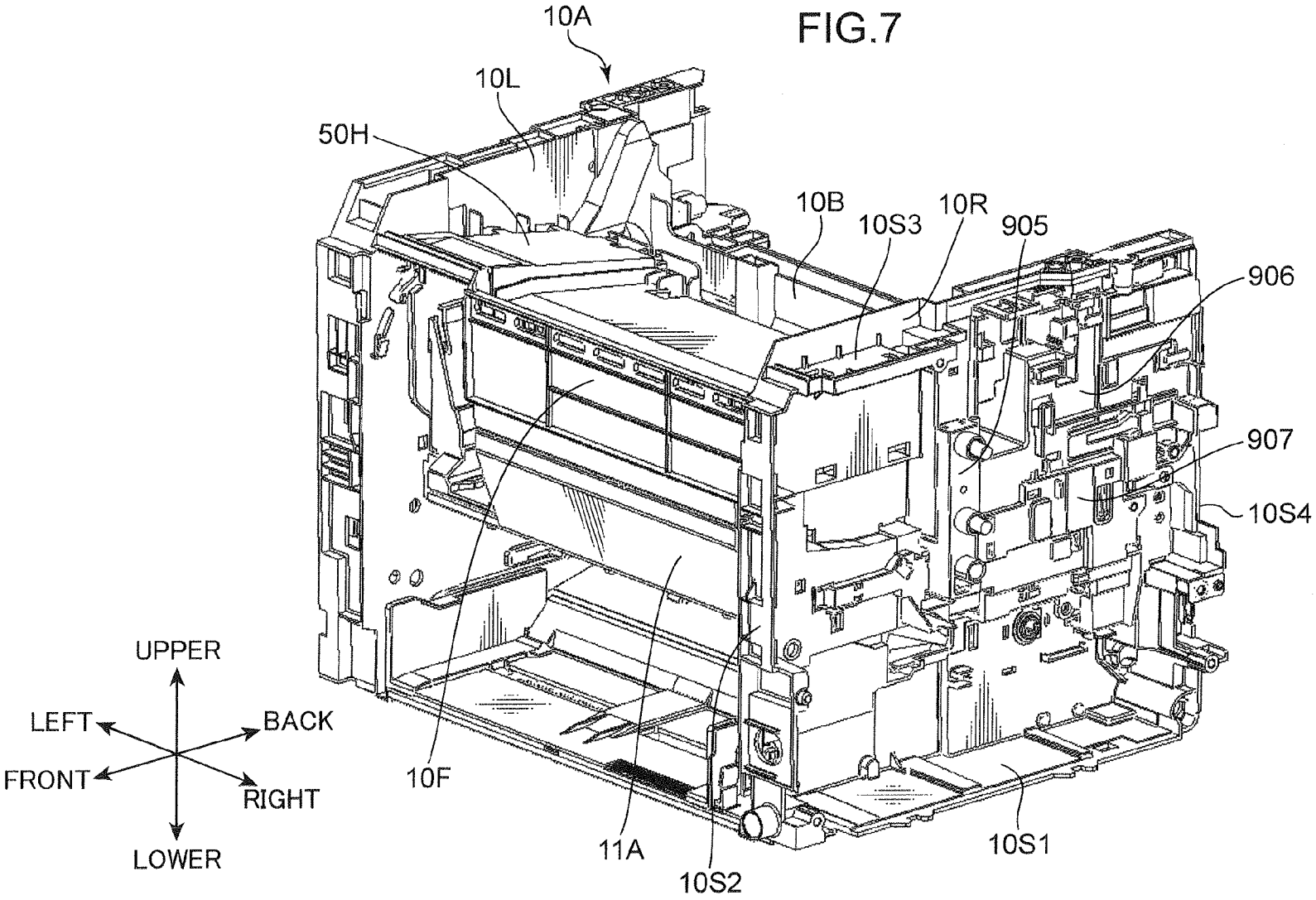
FIG. 7 is a perspective view for explaining the main body frame 10A according to an embodiment of the present disclosure.

Next, placements of the main body frame 10A and the substrate unit 70 are further described in detail with reference to FIGS. 6 to 8. FIG. 6 is a perspective view of the main body frame 10A alone. FIG. 7 is a perspective view showing a state in which a plurality of electrical components are attached to the main body frame 10A shown in FIG. 6. FIG. 8 is a perspective view showing a state in which the substrate unit 70 is attached to the main body frame 10A shown in FIG. 7.

With reference to FIG. 6, the main body frame 10A has a bottom surface frame 10S, the left frame 10L, the right frame 10R, a rear frame 10B, a container top plate 50H, and the front frame 10F. The main body frame 10A also has a bottom surface protruding section 10S1, a front surface protruding section 10S2, an upper surface protruding section 10S3, and a rear surface protruding section 10S4.

The bottom surface frame 10S corresponds to a bottom surface section of the main body frame 10A. Left and right end sections of the bottom surface frame 10S are disposed in such a manner that the left frame 10L and the right frame 10R stand upright.

The rear frame 10B is disposed behind the left frame 10L and the right frame 10R. The rear frame 10B connects the left frame 10L and the right frame 10R behind the main body frame 10A.

The container top plate 50H and the front frame 10F are disposed in front of the left frame 10L and the right frame 10R. The container top plate 50H and the front frame 10F are disposed so as to be adjacent to each other in the horizontal direction. The front portions of the left frame 10L and the right frame 10R are coupled to each other by the container top plate 50H and the front frame 10F.

The bottom surface protruding section 10S1 is disposed below the right frame 10R. The bottom surface protruding section 10S1 is disposed such that a right-side end section of the bottom surface frame 10S extends to the right (outside) further than the right frame 10R does. The front surface protruding section 10S2, the upper surface protruding section 10S3, and the rear surface protruding section 10S4 are wall portions coupled to the right frame 10R. The front surface protruding section 10S2, the upper surface protruding section 10S3, and the rear surface protruding section 10S4 are formed by projecting parts of a front-side edge, upper-side edge, and rear-side edge of the right frame 10R to the right, respectively.

In the present embodiment, the framework of the main body frame 10A is formed by the bottom surface frame 10S, and the left and right frames 10L and 10R that stand upright on the left and right end sections of the bottom surface frame 10S. The internal space S is formed between the left frame 10L and the right frame 10R. The image forming section 30 is disposed in the internal space S. With this space, the paper cassette 21 can be attached/detached and a sheet ejected from the paper ejecting section 13 can be removed, in a direction parallel to the left frame 10L and the right frame 10R (lateral direction).

With reference to FIG. 7, various components are installed in the main body frame 10A shown in FIG. 6, when assembling the image forming apparatus 1. An inner cover 11A is disposed below the front frame 10F of the main body frame 10A. A first unit 905, a second unit 906, and a third unit 907 are disposed on a right-side surface of the right frame 10R. The first unit 905, the second unit 906, and the third unit 907 are electrical components for supplying predetermined drive voltages or control voltages to the image forming apparatus 1. The first unit 905, the second unit 906, and the third unit 907 are mounted in the right frame 10R so as to be lower than the distance in which the bottom surface protruding section 10S1 protruding from the right frame 10R to the right.

With reference to FIG. 8, the substrate unit 70 is installed in the main body frame 10A so as to oppose the right frame 10R of the main body frame 10A shown in FIG. 7. In this case, the power substrate 72, the high-voltage substrate 73, and the control substrate 74 (FIG. 5) of the substrate unit 70 are disposed so as to oppose the right frame 10R. The power substrate 72, the high-voltage substrate 73, and the control substrate 74 of the substrate unit 70 are disposed so as to enter a space defined by the right frame 10R, the bottom surface protruding section 10S1, the front surface protruding section 10S2, the upper surface protruding section 10S3, and the rear-surface protruding section 10S4 of the main body frame 10A. As a result, the electrical substrates can be confined in the space defined by the right frame 10R, the bottom surface protruding section 10S1, the front surface protruding section 10S2, the upper surface protruding section 10S3, the rear surface protruding section 10S4, and the shield metal plate 71 of the substrate unit 70. The connector section 95 with the plurality of connectors is disposed along a rear edge of the substrate unit 70 installed in the main body frame 10A. Therefore, electrical delivery between the substrate unit 70 and the other units housed in the main body housing 10 can be realized comprehensively behind the main body frame 10A.

Figure 9:
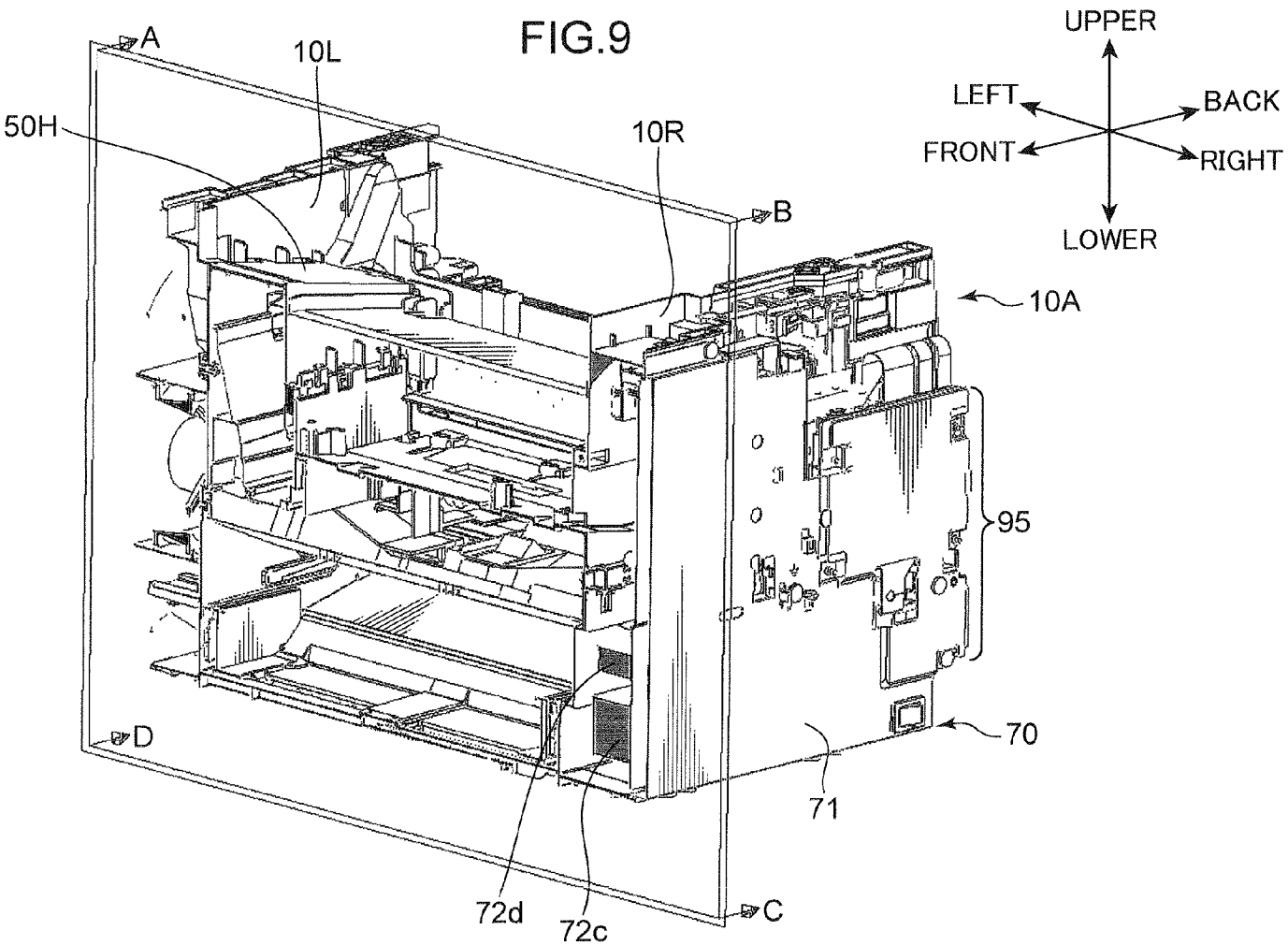
FIG. 9 is a cross-sectional perspective view for explaining the main body frame 10A according to an embodiment of the present disclosure.
Figure 10:
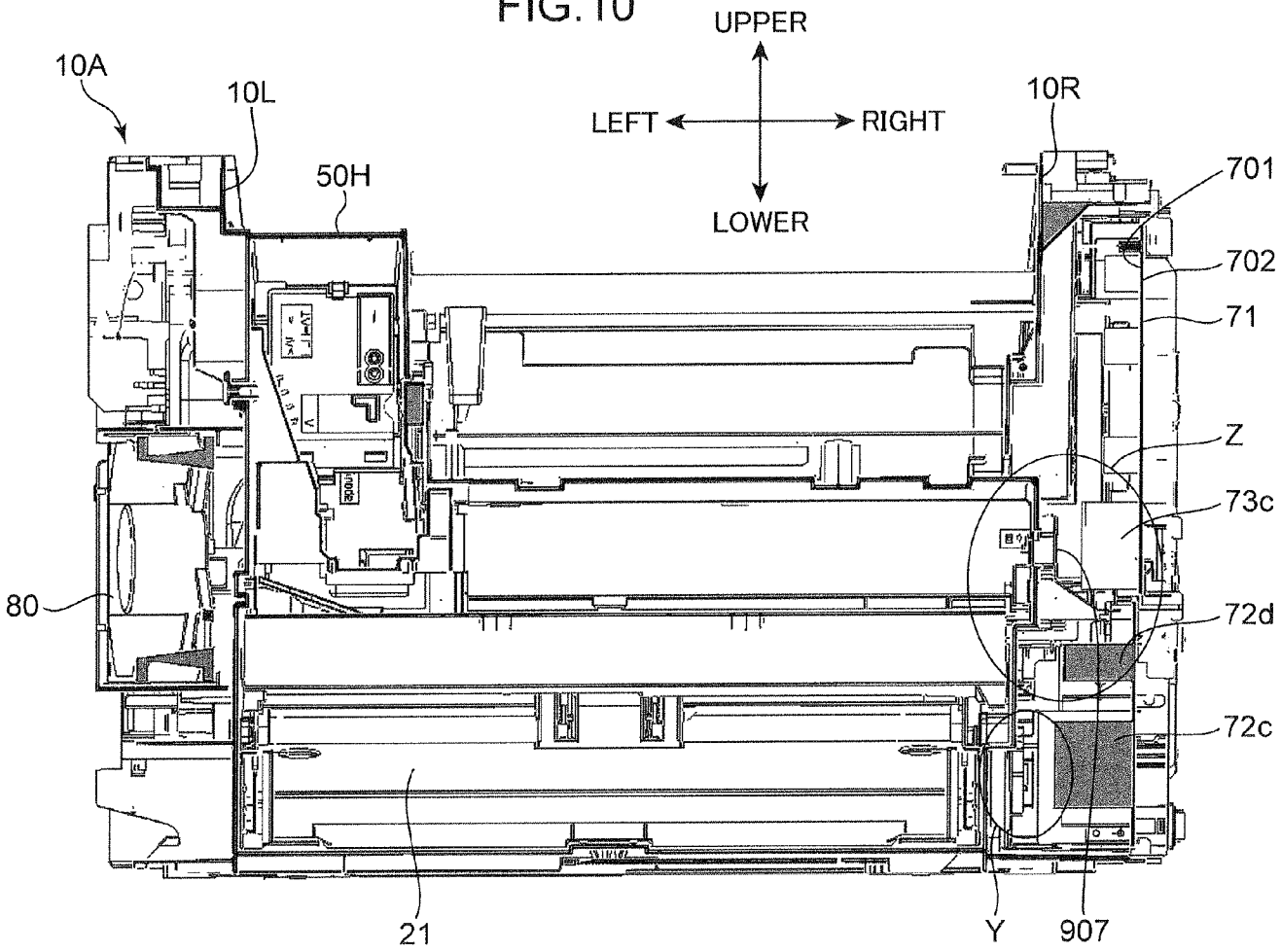
FIG. 10 is a cross-sectional view for explaining the main body frame 10A according to an embodiment of the present disclosure.

With reference to FIGS. 9 and 10, the placement of the substrate unit 70 is further described in detail. FIG. 9 is a cross-sectional perspective view of the main body frame 10A of FIG. 8 that is cut away along a plane surface passing points A, B, C and D. FIG. 10 is a cross-sectional diagram showing the front of the main body frame 10A shown in FIG. 9. These diagrams are obtained by cutting the substrate unit 70 in the middle in the lateral direction.

The substrate unit 70 mounted in the main body frame 10A is disposed in a right end section of the main body frame 10A. Of the shield metal plate 71 of the substrate unit 70, the power substrate 72, the high-voltage substrate 73, and the control substrate 74 are disposed on the metal plate inner surface section 701 side (FIG. 5). The electrical components, such as the power section 73*c* of the high-voltage substrate 73, and the coil 72*c* and the first capacitor 72*d* of the power substrate 72, protrude from the metal plate inner surface section 701 to the left.

In this manner, the right-hand side and the left-hand side of the power substrate 72, the high-voltage substrate 73, and the control substrate 74 of the substrate unit 70 are disposed in spaces surrounded by the shield metal plate 71 and the right frame 10R respectively. The electrical components are electrically protected as a result of shielding the outside (the right side) of the electrical components mounted in each substrate, by using the shield metal plate 71. Therefore, the electrical components of the power substrate 72, the high-voltage substrate 73, and the control substrate 74 are prevented from causing malfunctions due to noise transmitted from the outside of the image forming apparatus 1. In particular, in the present embodiment, the power substrate 72, the high-voltage substrate 73, and the control substrate 74 are electrically protected by being mounted on the single shield metal plate 71. Consequently, compared to a case where each of the substrates is stored in an individual shield member, the area of the shield members that electrically protect the substrate unit 70 can be further reduced, lowering the cost of the substrate unit 70.

In addition, the right frame 10R is disposed on the inside (to the left) of each electrical component so as to be opposite thereto. The right frame 10R is made from a flame-retardant resin material. By causing the shield metal plate 71 and the right frame 10R to surround the electrical components of the substrate unit 70, the plurality of substrates having the electrical components are electrically and structurally protected, and the flame-retardant countermeasures (fire enclosure) of the electrical components are realized. Note that, in the present embodiment, the main body frame 10A is a frame portion for supporting the main body housing 10, and the image forming section 30 is housed in the internal space S (FIG. 2) formed by the main body frame 10A. In particular, the image forming section 30 is disposed in such a manner as to be surrounded by the right frame 10R and the left frame 10L. Therefore, the main body frame 10A can realize not only the flame-retardant countermeasures of the substrate unit 70 but also the flame-retardant countermeasures of the image forming section 30.

With reference to FIG. 10, a region Y (first region) in which the tall electrical components such as the coil 72*c* are mounted and a region Z (second region) in which the electrical components shorter than the region Y, such as the power section 73*c*, are mounted, coexist in the metal plate inner surface section 701 of the substrate unit 70. In the present embodiment, the components such as the third unit 907 are disposed in the right frame 10R in such a manner as to oppose the region Z. In other words, an empty space similar to the region Z is formed on the left-hand side of the short electrical components in the electrical components disposed in the metal plate inner surface section 701 of the substrate unit 70. By disposing the components in the right frame 10R by favorably using this space, the space within the main body housing 10 is utilized effectively. As a result, the space occupied by the image forming apparatus 1 can be reduced as much as possible.

While the image forming apparatus 1 according to an embodiment of the present disclosure has been described, the present disclosure is not limited thereto and, for example, modifications such as described below can be adopted.

Figure 11:
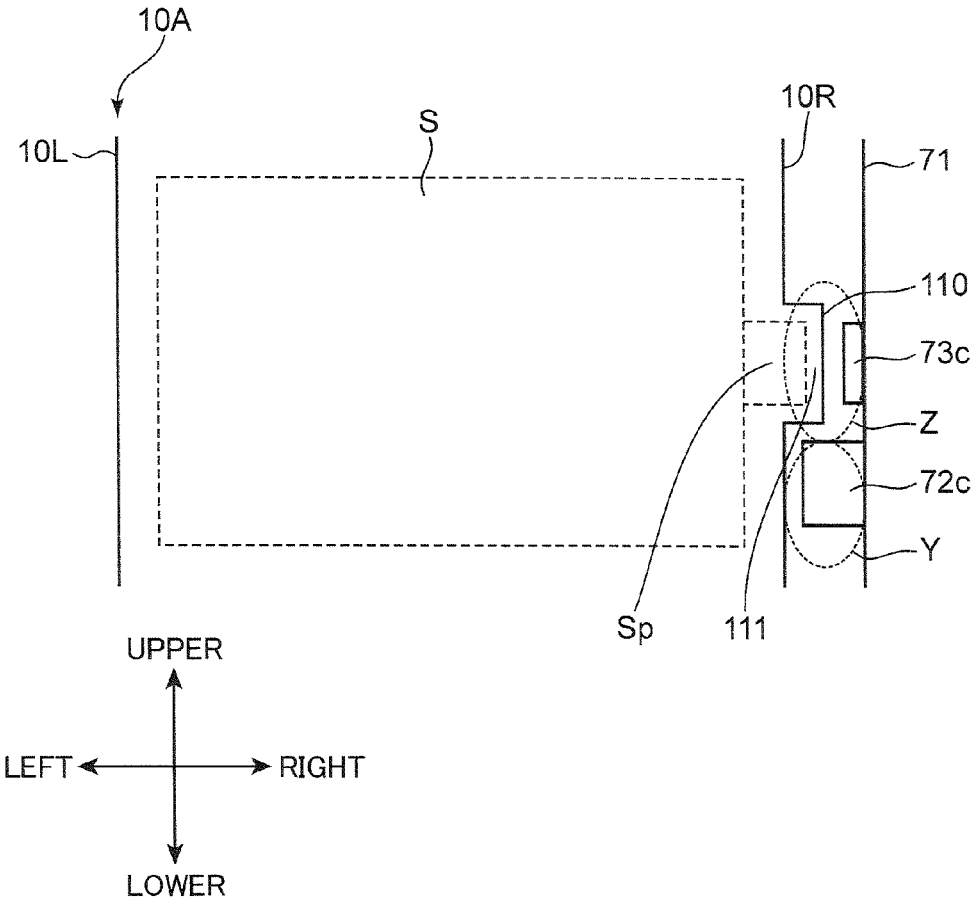
FIG. 11 is a cross-sectional view for explaining the main body frame 10A according to another embodiment of the present disclosure.

While the embodiment has described a mode in which the third unit 907 and other components are disposed in the right frame 10R in such a manner as to oppose the region Z of the metal plate inner surface section 701, the present disclosure is not limited thereto. FIG. 11 is a cross-sectional diagram showing another embodiment in which the abovementioned region Z is used favorably. The right frame 10R has a bulging section 110 that bulges toward the metal plate inner surface section 701 so as to oppose the region Z of the metal plate inner surface section 701, and a concave section 111 facing the left cover 12L on an opposite side to the bulging section 110. In this case, the bulging section 110 of the right frame 10R bulges to the right in such a manner as to fill the left-side space (empty space) of the electrical components in the region Z of the metal plate inner surface section 701. By allowing the bulging section 110 to bulge to the right, the concave part 111 is formed on the side opposite to the bulging section 110 (the left side, the rear side). As a result, the internal space S on the left-hand side of the right frame 10R is partially expanded ("Sp" in FIG. 11), increasing the freedom of disposing the image forming section 30 and the like. Consequently, the other components can be disposed in such a manner as to enter the concave section 111.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

a chassis having a first wall and a second wall opposite the first wall, the first wall and the second wall extending in a vertical direction, at least the second wall of the chassis being made from a resin material;

an image forming section disposed in an internal space formed between the first and second walls of the chassis and performing an image forming process on a sheet;

a shield metal plate provided vertically between the second wall and the image forming section and having a first surface facing toward the first wall and a second surface facing toward the second wall;

a plurality of substrates provided vertically on the first surface of the shield metal plate and having electrical components protruding toward the first wall, a predetermined voltage being supplied to the electrical components; and a main body frame provided inside the chassis, the main body frame being made from a flame-retardant resin material having a flame-retardant grade higher than a flame retardant grade of the resin material of the second wall of the body, the main body frame supporting the image forming section and having a wall section disposed between the shield metal plate and the image forming section, the wall section extending in the vertical direction and facing the first surface of the shield metal plate so that the substrates are between the shield metal plate and the wall section.

2. The image forming apparatus according to claim 1, wherein the shield metal plate is grounded, and the plurality of substrates are electrically connected to the shield metal plate.

3. The image forming apparatus according to claim 1, wherein the shield metal plate has a rectangular shape, and a plurality of electrical connectors disposed in the substrates along one side of the rectangular shape of the shield metal plate are further provided.

4. An image forming apparatus comprising:

a chassis having a first wall and a second wall on an opposite side to the first wall;

an image forming section disposed in an internal space formed between the first and second walls of the chassis and performing an image forming process on a sheet;

a shield metal plate provided vertically between the second wall and the image forming section and having a first surface facing toward the first wall and a second surface facing toward the second wall;

a plurality of substrates provided vertically on the first surface of the shield metal plate and having electrical components protruding toward the first wall, the substrates having a first region in which the electrical components of a first height are disposed and directed toward the first wall, and a second region in which the electrical components of a second height shorter than the first height are disposed and directed toward the first wall;

a main body frame provided inside the chassis, the main body frame having a wall section disposed between the shield metal plate and the image forming section, and the substrates being disposed between the wall section and the shield metal plate; and a further component protruding from the wall section toward the second wall so as to oppose the second region.

5. An image forming apparatus, comprising:

a chassis having a first wall and a second wall opposite the first wall;

an image forming section disposed in an internal space formed between the first and second walls of the chassis and performing an image forming process on a sheet;

a shield metal plate provided vertically between the second wall and the image forming section and having a first surface facing toward the first wall and a second facing toward the second wall;

a plurality of substrates provided vertically on the first surface of the shield metal plate and having electrical components protruding toward the first wall, the plurality of substrates having a first region in which the electrical components of a first height are disposed and directed toward the first wall, and a second region in which the electrical components of a second height shorter than the first height are disposed and directed toward the first wall; and a main body frame provided inside the chassis, the main body frame having a wall section disposed between the shield metal plate and the image forming section, and the substrates being disposed between the wall section and the shield metal plate, the wall section having:

a bulging section that bulges toward the second wall so as to oppose the second region; and a concave section facing the first wall on an opposite side to the bulging section.

6. The image forming apparatus according to claim 1, wherein the main body frame further has a counter wall section disposed between the first wall and the image forming section, and the image forming section is surrounded by the wall section and the counter wall section.

7. The image forming apparatus according to claim 6, further comprising:

a cooling fan that is disposed in the counter wall section and generates an airflow oriented toward the internal space.

8. The image forming apparatus according to claim 7, wherein the cooling fan generates the airflow that flows toward the plurality of substrates via the internal space.

* * * * *